US005863073A

United States Patent [19]

Taskett

[11] Patent Number: 5,863,073

[45] **Date of Patent: *Jan. 26, 1999**

[54] REFUNDABLE TRAVELLERS CHEQUES

[75] Inventor: John M. Taskett, Salt Lake, Utah

[73] Assignee: American Express Travel Related Services, New York, N.Y.

[ * ] Notice: The term of this patent shall not extend beyond the expiration date of Pat. No. 5,684,291.

[21] Appl. No.: 747,869

[22] Filed: Nov. 14, 1996

[51] Int. Cl.[6] ..... B42D 15/10

[52] U.S. Cl. ..... 283/58; 283/57; 283/74; 283/72; 283/102

[58] Field of Search ..... 283/57–59, 72, 283/74, 75, 100, 101, 103, 105, 108, 102; 235/487, 380, 379

[56] References Cited

U.S. PATENT DOCUMENTS

| | | | |
|---|---|---|---|
| 3,950,015 | 4/1976 | Shrock | 283/57 X |
| 4,614,365 | 9/1986 | Tresser | 283/58 X |
| 4,944,532 | 7/1990 | Pollard | 283/58 X |
| 5,353,335 | 10/1994 | D'Urso et al. . | |
| 5,442,162 | 8/1995 | Armel | 235/380 X |
| 5,684,291 | 11/1997 | Taskett | 235/487 |

FOREIGN PATENT DOCUMENTS

| | | |
|---|---|---|
| 956912 | 8/1995 | South Africa . |
| 2 109 745 | 6/1983 | United Kingdom . |
| 2 195 319 | 4/1988 | United Kingdom . |
| WO 95/12169 | 5/1995 | WIPO . |
| WO 96/38813 | 12/1996 | WIPO . |

*Primary Examiner*—Frances Han
*Attorney, Agent, or Firm*—Snell & Wilmer L.L.P.

[57] ABSTRACT

A secure manner for issuing travellers cheques and other instruments is provided which overcomes many of the shortcomings associated with known devices. In particular, the present invention provides a device which permits an issuer of prepaid instruments to securely provide credit, replacement, or reimbursement to a purchaser who has lost or had stolen a prepaid instrument.

14 Claims, 4 Drawing Sheets

REFUNDABLE TRAVELLERS CHEQUES

TECHNICAL FIELD

The present invention relates, generally, to a system apparatus and method for issuing secured prepaid instruments, such as travellers cheques, which can be replaced if lost or stolen; and more particularly, to a travellers cheque bearing a unique serial number issued with a document containing a replacement code to be employed by the customer to report a lost or stolen cheque.

BACKGROUND ART AND TECHNICAL PROBLEMS

Travellers cheques have been used around the world for over 100 years. In the United States alone, more than $25 billion dollars are spent each year by consumers purchasing travellers cheques.

A travellers cheque is typically issued for a particular country in that country's currency. For example, a travellers cheque issued for use in the United States would typically be issued bearing a "USA" or "United States" designation and issued in denominations of $20, $50, $100, and the like. Similarly, travellers cheques issued for use in other countries would carry that country's designation and be issued in convenient round denominations of that country's currency.

Travellers cheques are intended to be signed by the purchaser at the time of purchase, for example on the front of the travellers cheque. When the purchaser desires to use the travellers cheque at a later time to pay for goods or services, the consumer again signs the travellers cheque so that the merchant accepting the travellers cheque can compare the two signatures. If the two signatures match, the merchant may presume that the person cashing the travellers cheque was the same person who purchased the travellers cheque. However, if the signatures do not match, the merchant may refuse the travellers cheques, reasoning that any sufficient lack of correspondence between the two signatures suggests that the person attempting to use the travellers cheque is not the rightful owner.

The popularity of travellers cheques is in large measure due to the ease with which refunds may be obtained in the event the cheques are lost or stolen. Typically, travellers cheques are purchased in a preassembled booklet which includes the travellers cheque or cheques and a purchase agreement sometimes referred to as a Purchase Agreement Form (PAF). In particular, the PAF sets forth the procedures for obtaining a refund or replacement for lost or stolen travellers cheques.

In order to obtain a refund for lost or stolen travellers cheques, a purchaser must generally satisfy, in some measure, a number of "before loss" requirements and a number of "after loss" requirements. Typical before loss requirements include: (i) the travelers cheque must be signed at or near the time of purchase by the purchaser; (ii) the travellers cheques must not have been countersigned (i.e. signed a second time) by the purchaser, which should only be performed at the time the cheques are cashed; (iii) the cheque has not been given to another person voluntarily; (iv) the cheque has not been used in violation of law; and (v) the cheque has not been seized by a court or government action. Typical after loss requirements include: (i) immediate notification to the issuer of the loss or theft of the cheque; (ii) informing the issuer of all relevant facts surrounding the loss or theft of the cheque and informing the police if asked to do so by the issuer; (iii) completion of appropriate refund forms in due course; (iv) assisting the issuer in any investigation; and perhaps most importantly, (v) the consumer seeking a refund or replacement must be able to identify the cheques, for example by informing the issuer of the serial numbers of the lost cheques.

The greatest difficulty in complying with the foregoing requirements generally surrounds the consumer's ability to report the serial numbers of the stolen travellers cheques. Although some prepackaged travellers cheque booklets provide a convenient place to record serial numbers, the average person's tendency is to retain the list of serial numbers in the booklet with the travellers cheques. Hence, if the travellers cheques are lost or stolen, the list of serial numbers is typically lost or stolen as well. A substantial percentage of travellers cheque purchasers simply do not record the serial numbers on a separate piece of paper and maintain that document separate and apart from the travellers cheques in a manner which provides ready access to the serial numbers when they are needed to report a loss.

If a consumer is unable to identify the serial numbers of lost or stolen travellers cheques, many issuers will deny a refund or replacement unless alternate evidence of a convincing nature is supplied tending to prove that the cheques were in fact lost or stolen. However, customer relations issues arise when the truthfulness of the consumer's assertion that his travellers cheques had been lost or stolen is questioned.

An alternate strategy is to provide refunds or replacements even if a consumer is unable to recite the serial numbers of the lost cheques. While this enhances customer relations and facilitates good will for the issuer, the resulting fraud and abuse is concomitantly high.

A system and method is thus needed which overcomes the shortcomings of refunding and replacing lost or stolen travelers cheques.

SUMMARY OF THE INVENTION

A secure manner for issuing travellers cheques and other instruments is provided which overcomes many of the shortcomings associated with known devices. In particular, the present invention provides a device which permits an issuer of prepaid instruments to securely provide credit, replacement, or reimbursement to a purchaser who has lost or had stolen a prepaid instrument.

In accordance with one aspect of the present invention, a travellers cheque device is provided which includes one or more travellers cheques. Each travellers cheque bears a unique identifier, such as a serial number. In accordance with a further aspect of the invention, at the time of purchase of the device the customer is provided a replacement code for each cheque, whereby the code is the same as or associated with the cheque's serial number. The replacement code may be printed on a document or instrument which is physically distinct (i.e., separate) from or separable from the cheque (or cheques). Both the cheques (each bearing a unique serial number) and the associated document (bearing the replacement code) are sold together, for example by packaging both the cheques and the replacement instrument in a single device (e.g., in an envelope). The travellers cheques also may be packaged in a traditional booklet wherein one of the cheques is conveniently removed, for example, by tearing the cheque from the booklet along a line of perforations. The replacement document bearing the replacement codes is, however, physically separate from the booklet. In this way, the booklet of travellers cheques may be carried in a billfold, wallet, or the like, such that the replacement document may be maintained in a secure place, like in a desk drawer or other location. In this way, if the booklet of cheques is lost, the replacement document is easily and conveniently retrieved.

By physically decoupling the replacement codes from the travellers cheques, a consumer may report the theft or other loss of the cheques based solely on the replacement codes. As a result, the thief or finder of the lost cheques would be unable to obtain credit, reimbursement, or replacement for the cheques because he or she will not have access to the replacement codes. Moreover, if the cheques are promptly reported as being lost or stolen, it may be possible to "broadcast" or otherwise inform a large number of potential merchants of this fact to prevent the lost or stolen cheques from being cashed. Alternatively, a system may be implemented where merchants are urged or required to confirm with a host computer that a particular cheque has not been lost or stolen before cashing the cheque. The system would operate in much the same way a credit card transaction is approved prior to consummation of the transaction. Confirmation may be obtained by transmitting a request for approval message to a central computer using a POS or similar device via a telephone or modem link with the host computer.

Regardless of whether the lost or stolen cheques may be cashed by an unauthorized finder or thief, the use of the aforementioned replacement code document ensures that refunds or replacements are given only to the consumer who in fact purchased the travellers cheques, thus reducing the fraud currently experienced by travellers cheque issuers.

BRIEF DESCRIPTION OF THE DRAWING FIGURES

The present invention will hereinafter be described in conjunction with the appended drawing figures, wherein like numerals denote like elements, and:

DETAILED DESCRIPTION OF PREFERRED EXEMPLARY EMBODIMENTS

Figure 1:
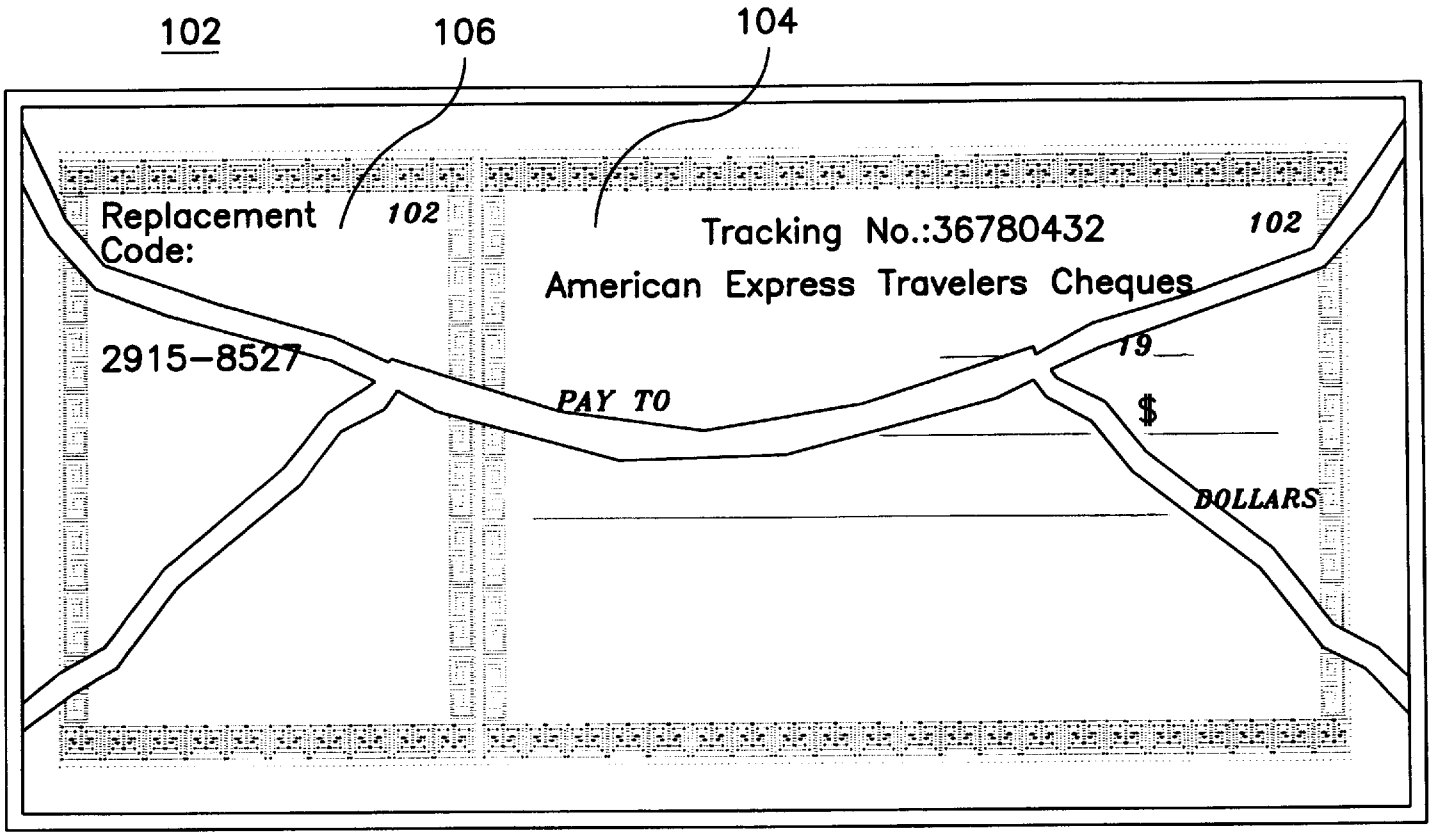
FIG. 1 is a front elevation view of a sealed envelope containing travellers cheques and a corresponding replacement instrument, shown in phantom within a sealed envelope.
Figure 2:
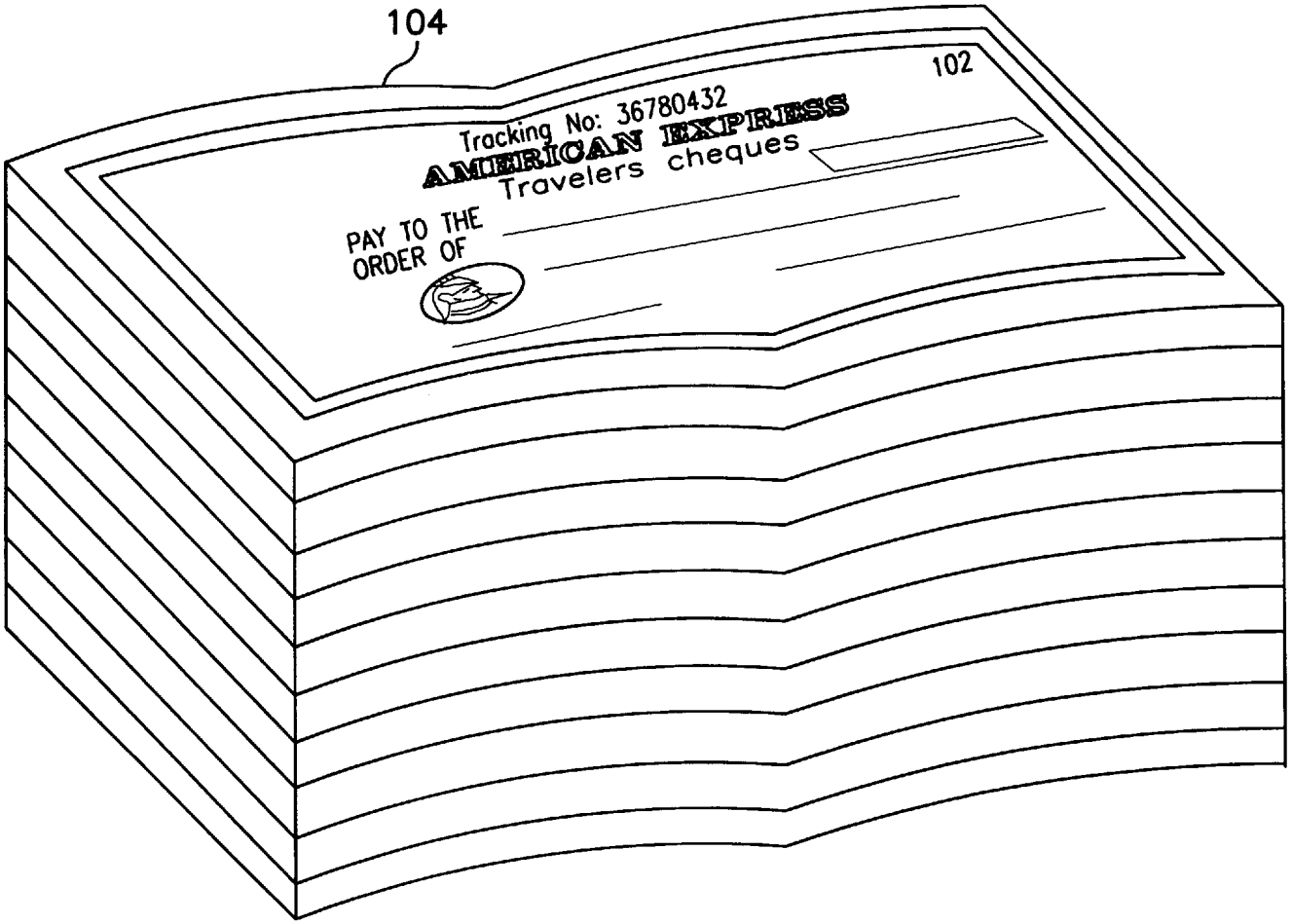
FIG. 2 is a perspective view of exemplary travellers cheques.

Referring now to FIG. 1, a secure system for issuing prepaid instruments suitably comprises one or more prepaid travellers cheques 104 and a separate replacement document 106, together comprising an ensemble 102 advantageously secured within a sealed envelope. In this context, it is envisioned that a plurality of similar ensembles would be provided by the issuer of the cheques to participating merchants, which merchants thereafter distribute the cheques to consumers on behalf of the issuer. Each time a merchant sells an ensemble 102 to a consumer, the merchant may activate the cheques, for example by communicating the tracking number to the issuer's host computer. The tracking number may appear on the outside of the envelope to the issuer.

Alternatively, a merchant could purchase cheques from the issuer, whereupon the cheques would be activated at the time the merchant purchases the cheques from the issuer. That system would avoid the need to activate the cheques at the time of sale to a consumer. That system could be particularly advantageous, for example, in the context of vending machine sales of travellers cheques where postsale activation would be cumbersome.

In accordance with a further aspect of the present invention, each of respective cheques 104 suitably includes the information necessary to allow a consumer to execute a cheque in the context of a commercial transaction for the purchase of goods or services. In this regard, the "goods" may relate to prepaid goods and services of virtually any kind, including data and information which may be sold through data networks, telephone networks, or the Internet.

A primary advantage associated with the present invention surrounds the ability of the issuer to provide the consumer with replacement, reimbursement, or credit for cheques which are lost or stolen. An issuer's ability to provide such credit, reimbursement, or replacement is not predicated solely on the consumer's ability to recall the serial number printed on a cheque. Rather, a consumer seeks a replacement for a lost or stolen cheque based on a replacement code (which may be the same as or related to the serial number on the cheque) associated with a document which is advantageously decoupled from the cheque booklet.

Figure 4:
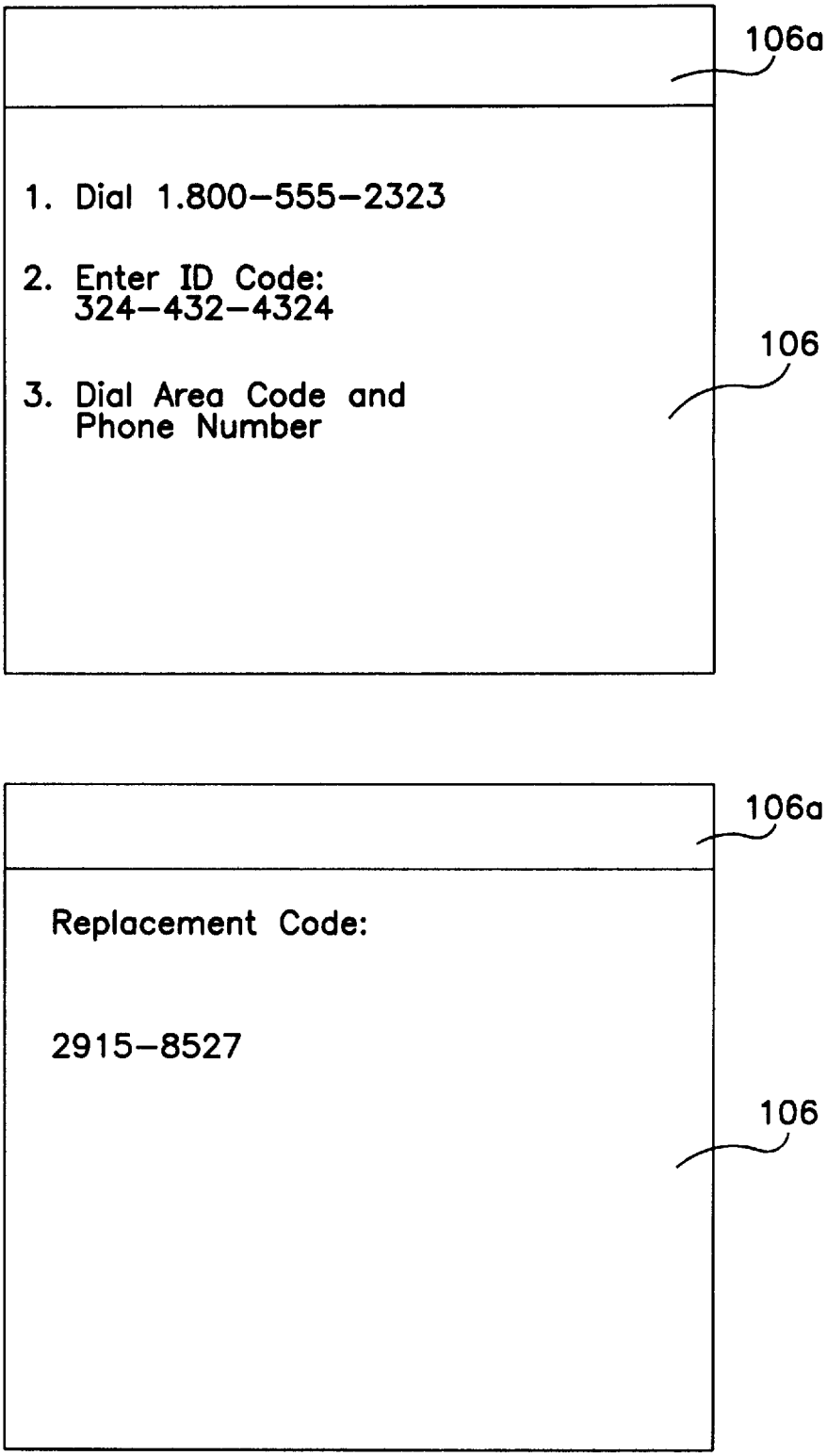
FIG. 4 shows an exemplary ensemble comprising travellers cheques combined with a replacement card.

In particular, an exemplary replacement document 106 suitably includes one or more replacement codes printed thereon, which may be retained by the consumer in a place separate from the cheques. Replacement document 106 may also have associated therewith a name and telephone number which the consumer may use to report lost or stolen cheques. As shown in FIG. 4 replacement document 106 suitably comprises a wallet-sized piece of paper, cardboard, or the like, which bears a sticky region 106*a* much like that of a Post-it™ note marketed by the 3-M Company of Minneapolis, Minn. In this way, the replacement document may be conveniently detached from the cheques, and releaseably adhered to a mirror, wall, desk, refrigerator or other convenient surface remote from the cheques yet readily retrievable by the consumer.

In order to demonstrate the utility of the present invention, a typical scenario involving the subject secure replacement scheme is described below.

During manufacture of the prepaid ensemble 102, the issuer produces respective cheques 104 and replacement document 106, such that the serial numbers on the cheques are either the same as, or related to, the replacement codes on the replacement document in accordance with a predetermined relationship known by the issuer of the cheques. For example, for each cheque the serial number and the replacement code may be identical, cryptographically related, or related via a look up table or other relational scheme maintained at the service provider's host computer. If a tracking number is used on the outside of the envelope within which the prepaid cheques and replacement document are sealed, the tracking number may also relate to at least one of the serial numbers and corresponding replacement codes, for example to permit activation of the cheque at the appropriate time (e.g., when purchased by a consumer from a merchant).

The manufacturer then places respective cheques 104 and replacement document 106 into an envelope, and seals the envelope prior to shipment to a merchant. By sealing the replacement codes within the envelope, the parties in the distribution chain (including the merchant) are unable to detect the replacement code and, hence, the risk of merchant fraud and other fraud against the issuer will be substantially reduced. That is, if a merchant were able to detect the replacement code(s) prior to sale of the ensemble to a consumer, the merchant or an employee of the merchant could conceivably call the issuer and fraudulently request replacement, reimbursement, or the like.

When a consumer desires to purchase the subject travellers cheques, either from a merchant, vending machine, or the like, he simply tenders payment in the form of cash, check, credit card, debit card, or the like to the merchant in exchange for ensemble 102. If the merchant has not already paid the issuer for the device, it may be appropriate for the merchant to activate the cheques upon receipt of payment from the consumer. As discussed above, the merchant may communicate the tracking number, which may be printed on the outside of the envelope, to the issuer thereby causing the issuer to activate the cheque or cheques within the envelope.

Alternatively, travellers cheques and associated replacement instruments may be distributed by organizations in connection with sales and marketing promotions. Alternatively, the cheques may be placed into the hands of consumers by virtually any distribution modality.

Once a consumer is in possession of cheques 104 and replacement card 106, the consumer should desirably retain the replacement instrument in a secure place remote from the cheques. Of course, if the consumer were to lose his replacement codes or have them stolen, the party in possession of the replacement codes could conceivably seek a replacement or refund from the issuer. However, in accordance with one aspect of the present invention, a consumer would be instructed to leave the replacement card in a secure place in a home, office, or the like.

Once a consumer has determined that the cheques have been lost or stolen, the issuer is contacted at a telephone number printed on replacement instrument 106, and the replacement code(s) are reported to the issuer. The issuer may then take any appropriate action, such as issuing new cheques and delivering them to the consumer; crediting the consumer's checking account, credit card, debit card, or the like; or disbursing cash to the consumer, either through an ATM machine or by having the consumer visit a satellite office of the issuing entity. Each respective cheque 104 suitably has printed thereon a unique serial number.

Figure 3:
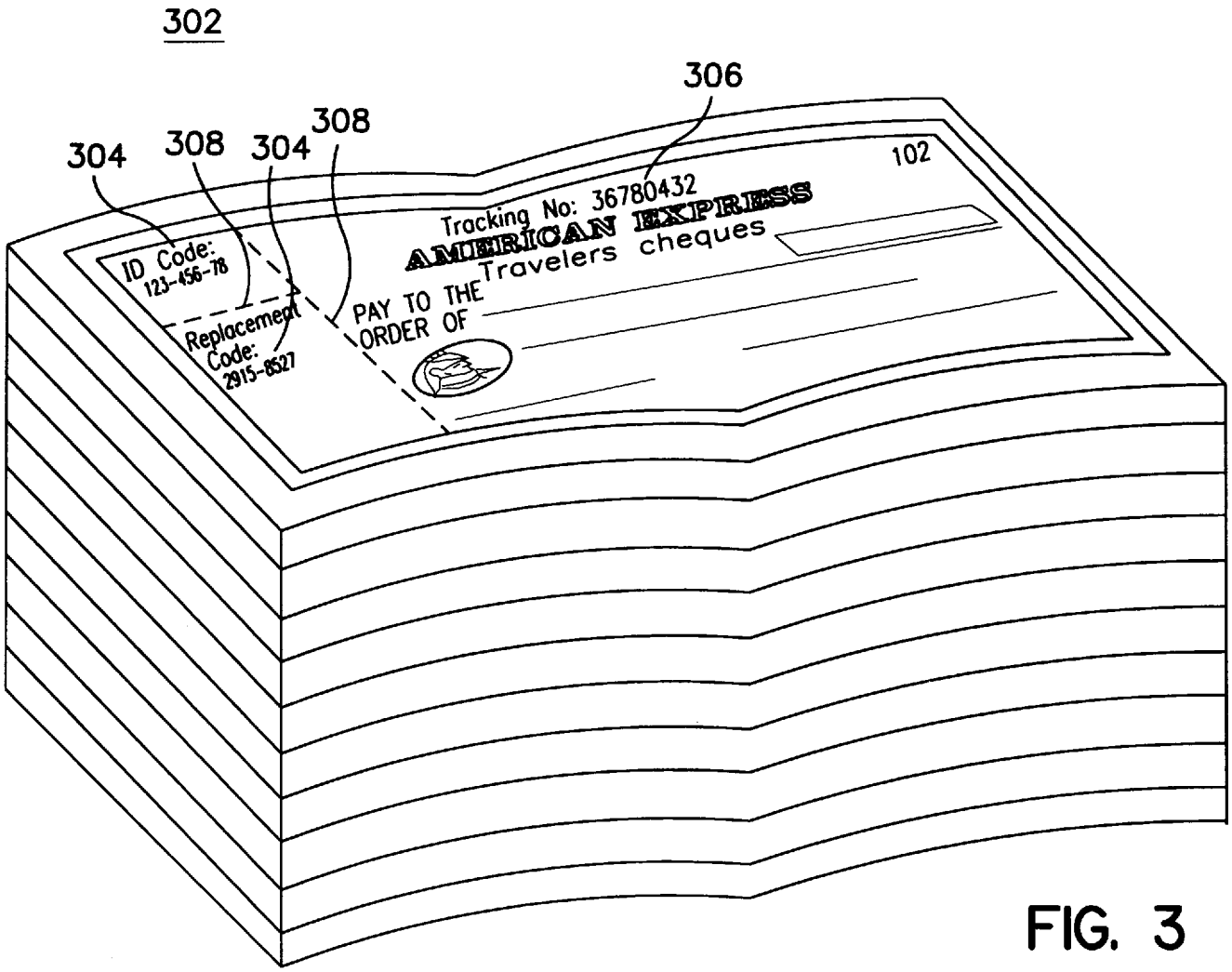
FIG. 3 is a perspective view of the replacement instrument shown in FIG. 1.

As shown in FIG. 3, a further alternative embodiment of the present invention suitably comprises a composite ensemble 302, comprising one or more cheques 306 and a replacement code portion 304, for example separated by a dotted, perforated, or other suitable detachable securing mechanism 308. In the embodiment shown in FIG. 3, the replacement code(s) is advantageously obscured, for example by a scratch off or other masking surface (not shown).

In accordance with one aspect of the alternate embodiment shown in FIG. 3, a sealed envelope is not necessary, inasmuch as the replacement code(s) may be concealed from the merchant and, indeed, from anyone else in the chain of distribution, until such time as composite device 302 is purchased by a consumer. In this regard, purchasers should be instructed to not purchase an ensemble if the replacement code is visible. In this way, merchant fraud against the issuer may be substantially reduced.

Upon purchasing a composite ensemble 302, for example from a vending machine, merchant, or the like, the consumer simply detaches the replacement code portion 304 from the cheques and stores the replacement code in a secure place remote from the corresponding cheques. Respective cheques 306, analogous to cheques 104 in FIG. 1, may then be carried by the consumer and used as described above. In the event the cheques are lost or stolen, the consumer may then retrieve replacement portion 304, scratch off surface 310 to reveal the replacement codes, and contact the issuer for a replacement, reimbursement, or the like.

Regardless of the particular manner in which the cheques and associated replacement document are packaged (i.e., whether in the form shown in FIG. 1, FIG. 3 or otherwise), it may be desirable to include some sort of Purchase Application Form (PAF) which sets forth some of the terms and conditions of sale and, more particularly, the terms and conditions which govern replacement or refund of the cheques if lost or stolen. More particularly, conventional travelers cheques often include as part of the purchase documentation a PAF which sets forth the general parameters for replacement of the travelers cheques. For example, PAF may state that the cheques are refundable by the issuer only if certain conditions are met, such as a requirement that the consumer keep the replacement document in a place separate from the cheques. In that event, if the replacement document is lost or stolen along with the cheques, the issuer is relieved of responsibility for replacement, refund, and the like. It would also be desirable for the PAF to include those terms and conditions which would limit the issuer's obligations to replacement or refund if the consumer fails to call within a specified period of time from the date of loss or theft of the cheques.

In the context of the present invention, the PAF may be printed directly on the composite device, the outside envelope, or it may comprise a separate sheet of paper which is separable from either the cheques, the replacement document, or any other convenient manner.

It will be understood that one of the functions of the replacement codes, as discussed herein, is to provide the issuer with sufficient indicia of reliability that the cheques were in fact lost and/or stolen and that the consumer desires replacement or a refund. However, virtually any criteria or sufficient indicia of creditability may be employed by an issuer to prove to the issuer's satisfaction that the consumer who is reporting the theft/loss is the rightful owner of the cheques. For example, (1) if the replacement code is lost or not conveniently retrievable by the consumer, and (2) if the consumer can otherwise show that he was likely the purchaser of the cheque, the issuer may nonetheless grant a refund or replacement. If the consumer is traveling on vacation, and the replacement document has been left at the home or office, it may be sufficient for the consumer to explain to the issuer where and when the cheques were purchased. Thus, the issuer would have a sufficiently reliable basis upon which to predicate a refund or a replacement.

Although the subject invention has been described herein in conjunction with the appended drawing figures, the scope of the invention is not so limited. Various modifications in the arrangement of the components discussed and the steps described herein for using various embodiments of the secured prepaid cheques discussed herein may be made without departing from the spirit and scope of the invention as set forth in the appended claims.

I claim:

1. A prepaid travellers cheque device comprising:

a travellers cheque having a serial number; and a replacement document having a replacement code corresponding to said serial number;

wherein the cheque and replacement document are obscured.

2. The device of claim 1, wherein said replacement code is identical to said serial number.

3. The device of claim 1, wherein said replacement code is cryptographically related to said serial number.

4. The device of claim 1, wherein said replacement code is related to said serial number via a look-up table located at an issuer's location.

5. The device of claim 1, wherein said cheque and replacement document are obscured by being securely disposed within a sealed envelope until purchased by a consumer.

6. The device of claim 5, wherein said envelope includes a tracking number imprinted thereon.

7. The device of claim 6, wherein said tracking number is related to said serial number.

8. The device of claim 1, wherein said replacement code is obscured by a masking surface.

9. The device of claim 1, wherein said replacement document is removably attached to said travellers cheque.

10. The device of claim 1, wherein said replacement document is removably attached to said travellers cheque by a perforated attachment.

11. The device of claim 1, wherein said replacement document is removably attached to said travellers cheque by a sticky substance.

12. The device of claim 1, wherein said replacement document is physically separate from said travellers cheque.

13. The device of claim 1, wherein a second replacement document is removably attached to said travellers cheque.

14. The device of claim 1, wherein said replacement document further includes a telephone number.

* * * * *